US005269086A

United States Patent [19]

Tomes

[11] Patent Number: 5,269,086

[45] Date of Patent: Dec. 14, 1993

[54] DECORATIVE PHOTO/IMAGERY DISPLAY AND DATE REMINDER

[76] Inventor: William A. Tomes, 1955 Fountainview, #107, Houston, Tex. 77057

[21] Appl. No.: 940,056

[22] Filed: Sep. 3, 1992

[51] Int. Cl.[5] ..... G09F 7/00

[52] U.S. Cl. ..... 40/486; 40/159; 40/492; 40/537; 434/404

[58] Field of Search ..... 40/152, 152.1, 159, 40/486, 492, 495, 124.2, 111, 537; 434/404, 405, 402; 446/149, 243; 116/42, 43

[56] References Cited

U.S. PATENT DOCUMENTS

| | | | |
|---|---|---|---|
| 1,617,831 | 2/1927 | Wolke | 434/404 |
| 1,634,713 | 7/1927 | Gaines | 434/404 |
| 1,877,476 | 9/1932 | Gillespie | 40/537 |
| 1,989,353 | 1/1935 | Davis | 40/495 X |
| 2,009,509 | 7/1935 | Megdall | 40/495 |
| 3,358,920 | 12/1967 | Ringley | 40/495 X |
| 4,058,916 | 11/1977 | Whyatt . | |
| 4,218,077 | 8/1980 | Ember . | |
| 4,587,377 | 5/1986 | Rodseth | 411/533 X |
| 5,105,567 | 4/1992 | Real | 40/152 X |

*Primary Examiner*—Kenneth J. Dorner
*Assistant Examiner*—Brian K. Green

[57] ABSTRACT

A multi purpose decorative frame and special date reminder for multiple photos/images. The date/information which is positioned next to its allied photo/image, in a symmetrical frame. When the front panel is rotated the date/information and photo/image can be singularly revealed while in the remaining frame openings only the photo/image will be visible bringing attention to the opening revealing both photo/image and date/information.

7 Claims, 4 Drawing Sheets

DECORATIVE PHOTO/IMAGERY DISPLAY AND DATE REMINDER

BACKGROUND OF THE INVENTION

This invention is a decorative device which can hang on a wall or be placed standing on a flat surface and will display photo/image wherein important dates and events can be highlighted chronologically.

Historically we have used a number of methods to remember important dates such as notebooks, bulletin boards, and attached notes on the refrigerator door to mention a few.

PRIOR ART

Whyatt and Ember, patents 4058916 and 4218077 respectively, fail to seperate and highlight a particular date specfically. Their purposes are broad and the applications are complicated. The institutional types of material used, and the concept suggest an office situation rather than an attractive design which would enhance the decor of a home. In addition, the abundance of information which can be viewed at one time deters from the highlighted awareness of a current date which should be attended.

SUMMARY

The device of this invention is a decorative piece which will compliment any decor and serves to be a constant reminder of important dates that might be forgotten. The plurality of frame openings allow visual access to all photos or images the configuration of the frame openings allows for the rotatable highlighting of a single photo/image with date/information.

OBJECTS AND ADVANTAGES

This invention provides;

A. A visable reminder for special dates.

B. A decorative frame holding a plurality of photos-/images which can be hung on a wall or placed standing on a piece of furniture.

C. Uncomplicated application of the photos/images and their respective dates from the outer periphery of the apparatus so that no re-assembly is required.

D. The area of the important date is highlighted by frame size to become a very evident constant reminder.

E. A design which is flexible to all decors and is a decorative enhancement.

F. The ability to revolve the circular frame to a position of attention of the most chronological important date and photo/image simply by hand turning the front panel.

G. That all photos/images inserted in the device are visable at all times.

BRIEF DESCRIPTION OF THE FIGURES IN THE DRAWINGS

FIG. 1 Front angled.

FIGS. 2A and 2B Direct front and large frame opening rotated.

FIG. 3 Exploded view.

FIGS. 4A and 4B Side view. Three functional members and five pivotal parts.

FIGS. 5A, 5B, and 5C Front view. Three main members.

REFERENCE NUMERALS

10 Front panel
12 Vinyl pocket unit
14 Back panel
16 Large circular frame opening
18 One of seven small circular openings
20 Screw hole plug
22 Bolt aperture
24 T nut
26 Rubber washer/spacer
28 Bolt aperture
30 Photo/image pocket
32 Date pocket
34 Bolt aperture
36 Metal washer
38 Flat headed counter sinking bolt

DESCRIPTION OF THE PREFERRED EMBODIMENT

Figure 1:
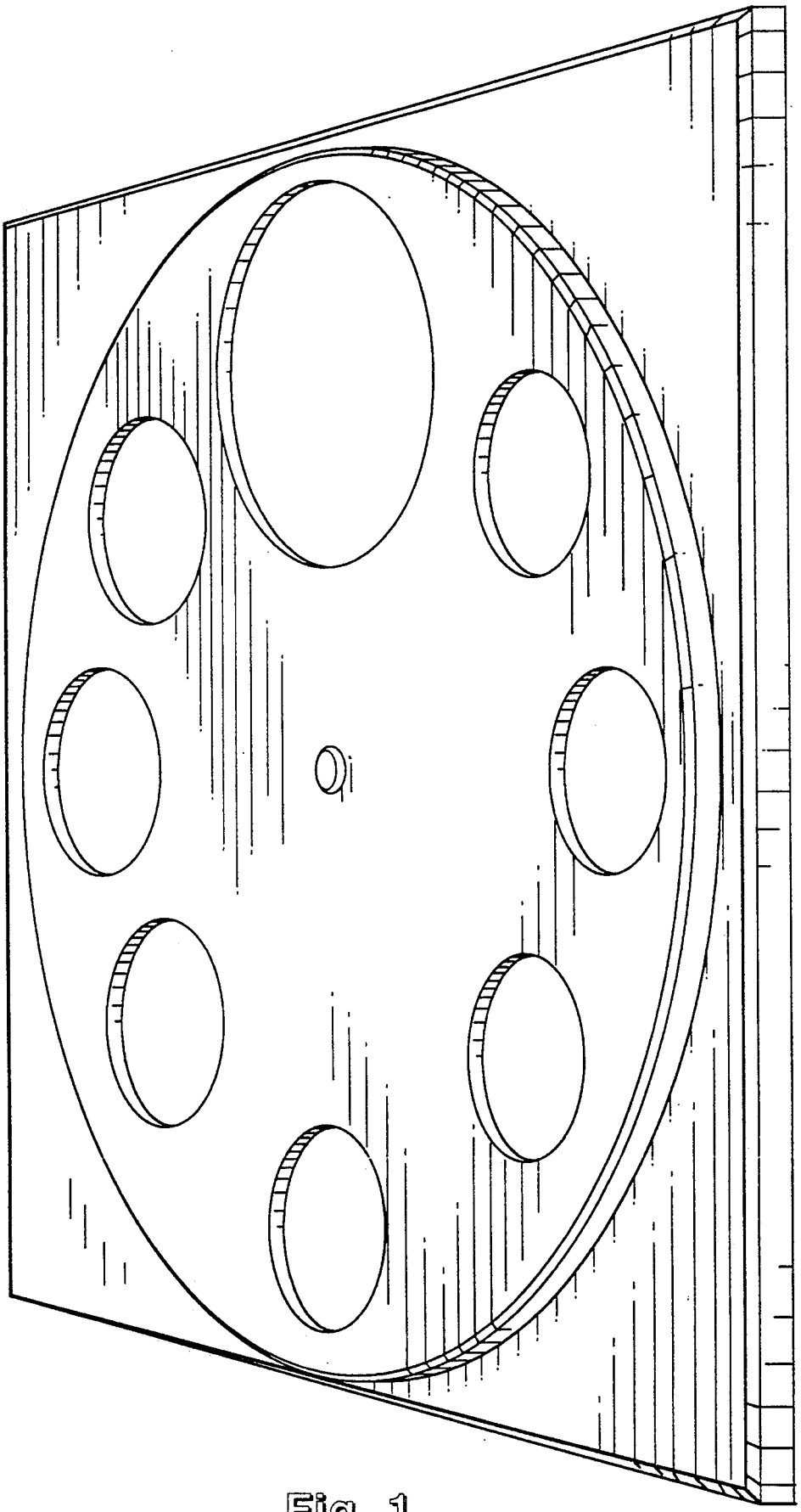
Figure 2A:
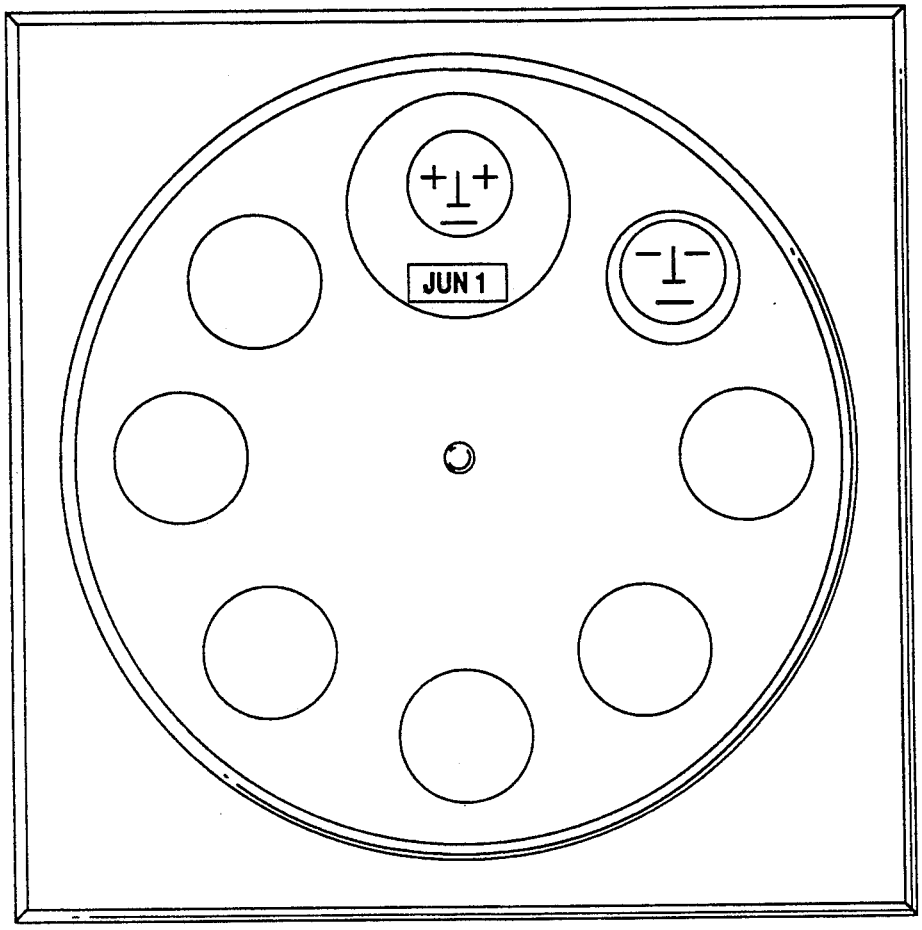
Figure 2B:
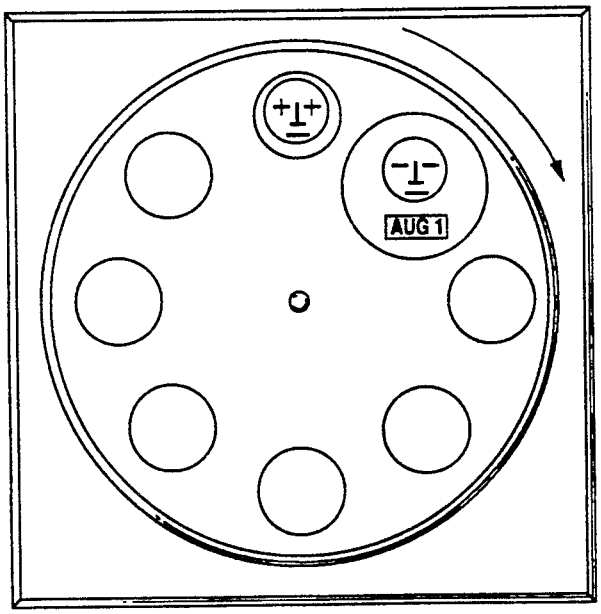
Figure 3:
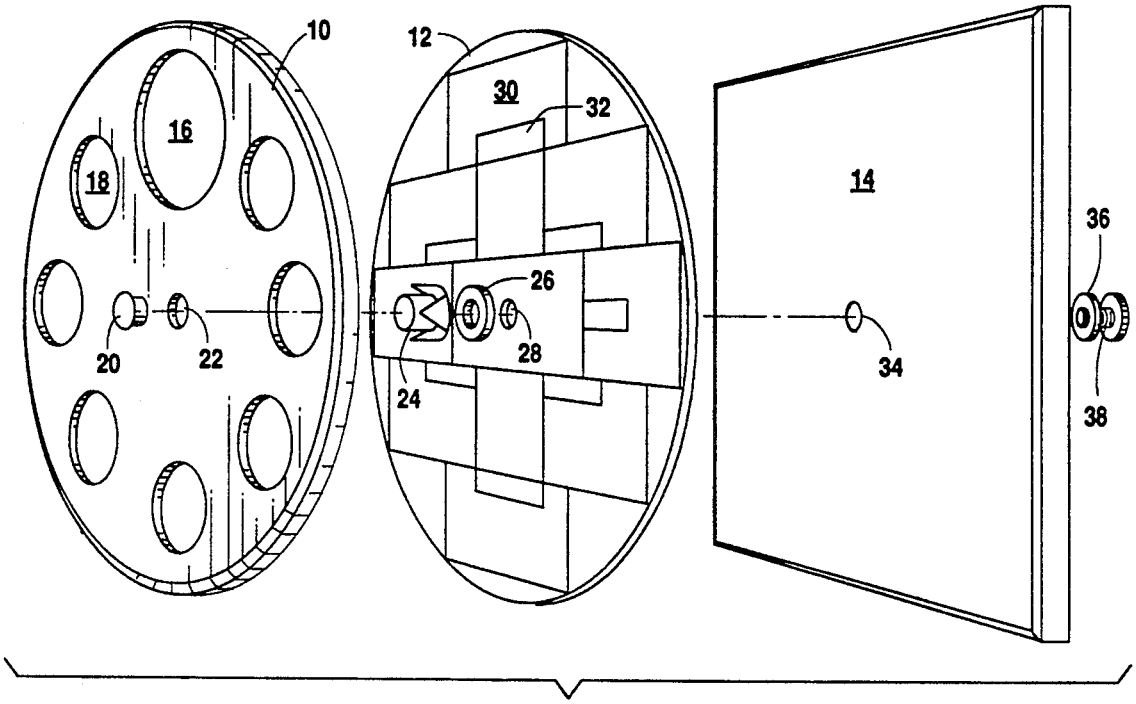
Figure 4A:
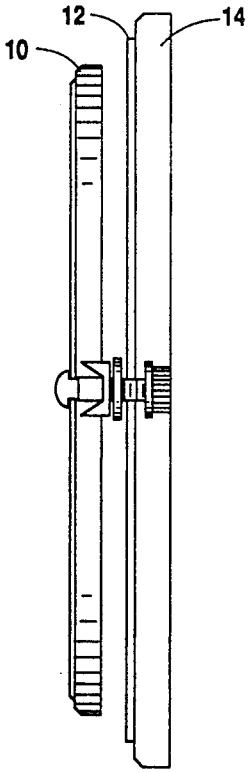
Figure 4B:
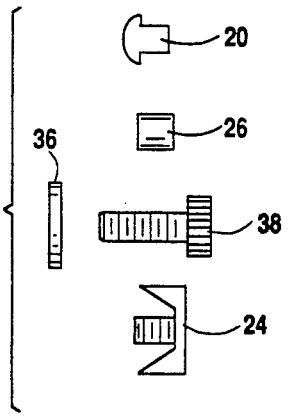

There are three main members of this device. The front circular panel 10, which is shown as wood, includes one circular frame opening 16 and seven additional circular frame openings 18 which are smaller than the aforementioned 16. The said panel 10 is shown as routed around the front circumference.

The circular unit 12 is an unpigmented non-glare vinyl unit with eight strategically placed rectangular photos/images pockets 30 molded as part of the said unit 12. There are also eight strategically placed smaller date pockets 32 as part of the rectangular pockets 30.

The back square panel 14, which is shown as wood, is the panel to which circular unit 12 is positioned and mounted with adhesive. The said member 14 is shown as routed at the front perimeter.

A hole with a countersink is drilled on the back surface of back panel 14, bolt 38 is then inserted through washer 36 and positioned in the hole so that the head of bole 38 when assembled will be flush with the surface of back panel 14 and washer 36 will to allow blot 38 turn when circular panel is rotated. Bolt 38 continues through aperture's 34,28, and 22 in order to fasten the main members 10, 12, and 14 together. Between panel 10 and vinyl unit 12 the bolt 38 is also inserted through rubber washer/spacer 26. Bolt 38 is then engaged with T nut 24. A hole with a countersink is drilled on the front surface of front panel 10 enabling T nut 24 to be recessed so that screw hole plug 20, which is shown as wood, can be inserted and secured with adhesive to the front center of panel 10, concealing the T nut 24 in aperture 22.

Figure 5A:
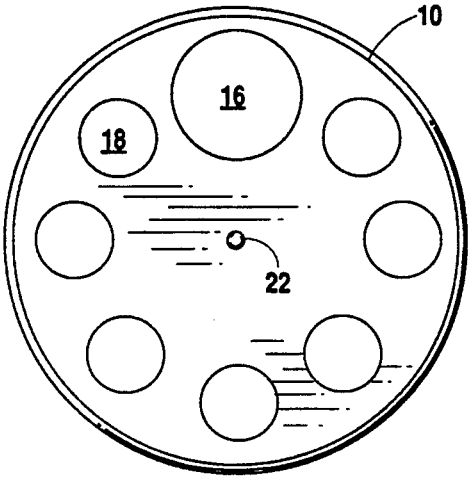
Figure 5B:
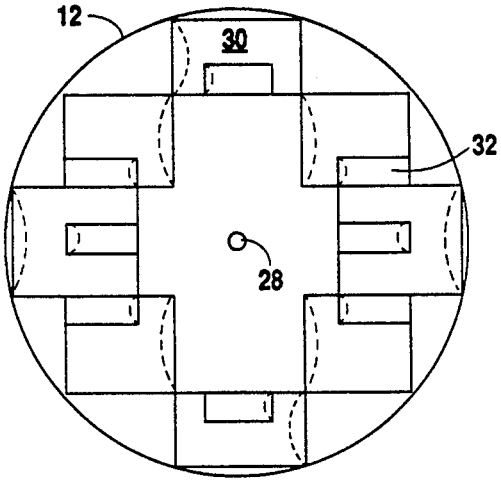
Figure 5C:
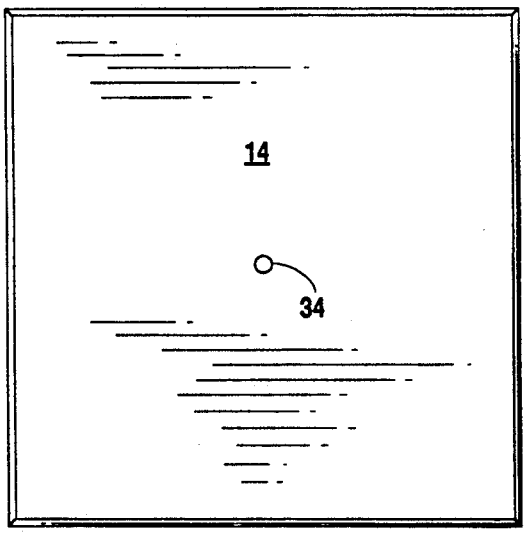

An additional view of the main members seperated can be seen in FIG. 5. When the panel 10 is placed over the vinyl pocket 12 the large circular frame opening 16 allows visability of one of the rectangular photo/image pockets 30 as well as the smaller dated pockets 32 while the seven other smaller circular openings 18 show only the photo/image the pocket 30. The date pockets 32 are strategically located so that they are only visable when the large circular frame 16 is adjacent to one of the eight pockets 30.

It should be noted that the rubber washer/spacer 26 function is not only to seperate panel 10 from vinyl pocket 12, but because of the nature of the rubber material of the washer/spacer 26 smooth rotation is produced.

While the simplicity and ease of operation as well as the distinct decorative mode of the device are foremost features, the opportunity for additional applications are present. A variety of materials could be used in the main embodiment allowing the device to be employed in an institutional enviroment as well as the home. Without detering from the essence of the device other featured memorabilia or information could be introduced for their special attention.

What is claimed is;

1. A photo/image display and date device comprising:

a. A front rotatable panel with a plurality of frame openings, one of said frame openings being larger relative to all remaining openings, b. A panel member supporting a plurality of strategically positioned pocketed divisions, each of the pocketed divisions including a first pocket and a second pocket, the second pocket being smaller in size relative to the first pocket, c. A back supporting panel, d. A locking assembly that interconnects the front rotatable panel, the panel member, and back supporting panel together, the locking assembly providing a means for allowing the front panel to rotate relative to the panel member and back supporting panel, and the larger frame opening providing a means for allowing respective first and second pockets of one of said pocketed divisions to be viewed when the larger frame opening is located above one of said pocketed divisions.

2. A photo/image display and date device as in claim 1 wherein said pocketed divisions of said panel member allows the securable and removable positioning and protection of photo/image and date/information.

3. A photo/image display and date device as in claim 1 wherein said frame openings on said front rotatable panel are uniformly arranged along an outer circumference of said front rotatable panel.

4. A photo/image display and date device as in claim 1 wherein said each of first pockets includes a label positioned therein.

5. A photo/image display and date device as in claim 1 wherein said front rotatable panel is rounded on its outer circumference.

6. A photo/image display and date device as in claim 1 wherein said locking assembly is centrally located in relation to said front rotatable panel and concealed.

7. A photo/image display and date device as in claim 1 wherein said locking assembly has a rubber washer positioned between said front rotatable panel and said panel member to keep said locking assembly from separating and to prevent said front rotatable panel from slipping after being positioned.

* * * * *